US009403650B2

(12) United States Patent
Katsura et al.

(10) Patent No.: US 9,403,650 B2
(45) Date of Patent: Aug. 2, 2016

(54) SHEET FEEDING DEVICE AND IMAGE FORMING APPARATUS

(71) Applicant: Sharp Kabushiki Kaisha, Osaka-shi, Osaka (JP)

(72) Inventors: Norichika Katsura, Osaka (JP); Yasuaki Fukada, Osaka (JP); Yoshiyuki Kobayashi, Osaka (JP); Yoshiteru Kikuchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/607,172

(22) Filed: Jan. 28, 2015

(65) Prior Publication Data

US 2015/0210490 A1 Jul. 30, 2015

(30) Foreign Application Priority Data

Jan. 29, 2014 (JP) ..... 2014-014667

(51) Int. Cl.
*B65H 3/66* (2006.01)
*B65H 3/52* (2006.01)

(52) U.S. Cl.
CPC .. *B65H 3/66* (2013.01); *B65H 3/52* (2013.01); *B65H 3/5215* (2013.01); *B65H 3/5223* (2013.01); *B65H 3/5261* (2013.01); *B65H 2404/622* (2013.01)

(58) Field of Classification Search
CPC ..... B65H 3/52; B65H 3/5215; B65H 3/5223; B65H 3/5261; B65H 3/66; B65H 3/0676; B65H 3/0684
See application file for complete search history.

(56) References Cited

U.S. PATENT DOCUMENTS

| | | | | |
|---|---|---|---|---|
| 6,485,014 | B1 * | 11/2002 | Lin | 271/121 |
| 7,591,461 | B2 * | 9/2009 | Lien et al. | 271/126 |
| 2013/0341851 | A1 * | 12/2013 | Mitamura | 271/109 |
| 2014/0021679 | A1 * | 1/2014 | Kato | 271/109 |

FOREIGN PATENT DOCUMENTS

| | | | |
|---|---|---|---|
| JP | 1-172141 | A | 7/1989 |
| JP | 7-206199 | A | 8/1995 |
| JP | 11334922 | A | * 12/1999 |
| JP | 2000344372 | A | * 12/2000 |
| JP | 2004-137021 | A | 5/2004 |
| JP | 2007-70003 | A | 3/2007 |
| JP | 2009-7086 | A | 1/2009 |

* cited by examiner

*Primary Examiner* — Luis A Gonzalez
(74) *Attorney, Agent, or Firm* — Keating & Bennett, LLP

(57) ABSTRACT

In a sheet feeding device, when a leading end of a recording sheet is guided to a nip region along a leading end portion of a sheet guide member in contact with a surface of a separation roller, the leading end of the recording sheet slides and moves on surfaces of projected end portions to be guided to the vicinity of the nip region, and the leading end of the recording sheet passes through the nip region quickly. Hence, a sheet feed error is much less likely to occur. Since a distance from recessed end portions to the nip region is longer and the leading end of the recording sheet is in contact with the separation roller for a longer time right after passing the recessed end portions until reaching the nip region, even though a plurality of recording sheets is stacked, the recording sheets are separated one by one by the separation roller, preventing a multi-sheet feed of the sheets.

8 Claims, 5 Drawing Sheets

SHEET FEEDING DEVICE AND IMAGE FORMING APPARATUS

BACKGROUND OF THE INVENTION

1. Field of the Invention

Preferred embodiments of the present invention relate to a sheet feeding device configured to feed sheets and an image forming apparatus including the sheet feeding device.

2. Description of the Related Art

This type of sheet feeding device includes a sheet feed tray to be loaded with sheets, a sheet feed roller, and a separation member to contact the sheet feed roller. Sheets are drawn from the sheet feed tray to be forwarded onto a sheet conveying path through a nip region between the sheet feed roller and the separation member. In a case where a stack of a plurality of sheets is drawn from the sheet feed tray, the sheets are separated one by one when the sheets pass through the nip region between the sheet feed roller and the separation member, for conveyance.

JP 2004-137021 A teaches that a guide film is placed in an area from the sheet feed tray to the surface of the separation member. The guide film acts to guide the sheets smoothly to the surface of the separation member, so as to prevent the sheets from being stuck in the middle of conveyance from the sheet feed tray to the separation member, thus eliminating sheet feed errors.

In a case where a guide film is disposed in an area from the sheet feed tray to the surface of the separation member as in JP 2004-137021 A, laying an elongated guide film over a wide area on the surface of the separation member decreases the area of contact of the surface of the separation member with respect to the sheets, which invites a multi-sheet feed in which a plurality of sheets is conveyed while being stacked. Shortening the guide film increases the area of contact of the surface of the separation member with respect to the sheets, which suppresses the occurrence of the multi-sheet feed. On the other hand, a curled leading end of a sheet may be hooked on the surface of the separation member, which hinders proper conveying of sheets, and the sheets are liable to experience sheet feed errors.

SUMMARY OF THE INVENTION

Preferred embodiments of the present invention were made in view of the foregoing circumstances, in order to provide a sheet feeding device and an image forming apparatus. A sheet feeding device according to a preferred embodiment of the present invention includes a sheet guide member including, for example, a guide film located in an area along a surface of a separation member and operable to significantly reduce or prevent multi-sheet feeds and sheet feed errors.

A sheet feeding device according to a preferred embodiment of the present invention includes a sheet feed tray configured to be loaded with sheets, a sheet guide member, a sheet feed roller configured to convey the sheets, and a separation member configured to separate the sheets in case of a multi-sheet feed. The sheets are adapted to be guided from the sheet feed tray along the sheet guide member to a nip region between the sheet feed roller and the separation member such that the sheets are forwarded through the nip region onto a sheet conveying path. A projected end portion and a recessed end portion are arranged on a leading end portion of the sheet guide member in a direction perpendicular or substantially perpendicular to a direction of conveyance of the sheets. The sheet guide member is directed toward a downstream side in the direction of conveyance. The projected end portion projects toward the downstream side in the direction of conveyance. The recessed end portion is recessed from the projected end portion toward an upstream side in the direction of conveyance.

In such a preferred embodiment of the present invention, the sheet guide member is disposed to guide the sheets drawn from the sheet feed tray to the nip region between the sheet feed roller and the separation member. The projected end portion and the recessed end portion are arranged on the leading end portion of the sheet guide member in the direction perpendicular or substantially perpendicular to the direction of conveyance of the sheets, the projected end portion projecting toward the downstream side in the direction of conveyance of the sheets, the recessed end portion being recessed toward the upstream side in the direction of conveyance of the sheets. Thus, the leading end of the sheet is guided in contact with the projected end portion to the vicinity of the nip region, and a sheet feed error is prevented. Further, since the recessed end portion is recessed away toward the upstream side in the direction of conveyance of the sheets, the distance from the recessed end portion to the nip region is longer, and the leading end of the sheet is in contact with the separation member for a longer time right after passing the recessed end portion until reaching the nip region. Thus, even though a plurality of sheets is stacked, the sheets are reliably separated one by one by the separation member, and a multi-sheet feed is prevented.

In the sheet feeding device according to a preferred embodiment of the present invention, projected end portions identical to the projected end portion are preferably arranged on two sides of the leading end portion of the sheet guide member in the direction perpendicular or substantially perpendicular to the direction of conveyance.

In this case, the leading end of the sheet is guided to the nip region with two portions of the leading end of the sheet that is in contact with the corresponding projected end portions. Thus, the sheets are prevented from veering off course, and a sheet feed error is more favorably prevented.

Moreover, in the sheet feeding device according to a preferred embodiment of the present invention, the projected end portion is preferably opposite to a lateral end of the separation member, the lateral end extending in the direction perpendicular or substantially perpendicular to the direction of conveyance.

In this case, even though the leading end of the sheet is curled, the leading end of the sheet is guided to the nip region without being hooked at, for example, a lateral end of the separation member. Thus, a sheet feed error is even more reliably prevented.

In the sheet feeding device according to a preferred embodiment of the present invention, the projected end portion is preferably opposite to a central portion of the sheet feed roller, the central portion being located in the direction perpendicular or substantially perpendicular to the direction of conveyance.

In this case, even though the leading end of the sheet is curled, a central portion of the leading end of the sheet contacts the projected end portion, such that the curling degree at the central portion of the leading end of the sheet is reduced. Thus, the curling at two sides of the central portion of the leading end is also reduced approximately equally, and the sheet is guided to the nip region with the two sides of the central portion of the leading end approximately straightened out, such that the sheets are less likely to veer off the course, and sheet feed errors are even more favorably prevented.

Moreover, in the sheet feeding device according to a preferred embodiment of the present invention, the projected end portion preferably has a smaller width in the direction perpendicular or substantially perpendicular to the direction of conveyance toward the nip region.

In this case, the area of contact of the leading end of the sheet with the separation member is increased after passing the recessed end portion, thus more favorably preventing a multi-sheet feed.

An image forming apparatus according to another preferred embodiment of the present invention includes a sheet feeding device according to one of the preferred embodiments of the present invention described above, and a printer configured to form an image on a sheet forwarded by the sheet feeding device.

Such an image forming apparatus according to a preferred embodiment of the present invention also provides similar effects to those of the sheet feeding device according to other preferred embodiments of the present invention.

According to various preferred embodiments of the present invention, the sheet guide member is provided to guide sheets drawn from the sheet feed tray to the nip region between the sheet feed roller and the separation member. The leading end portion of the sheet guide member is provided with a projected end portion projecting toward the downstream side in the direction of conveyance of the sheets and a recessed end portion recessed toward the upstream side in the direction of conveyance of the sheets, alternately in the direction perpendicular or substantially perpendicular to the direction of conveyance of the sheets. Thus, the leading end of the sheet is guided in contact with the projected end portion to the vicinity of the nip region, and sheet feed errors are prevented. Further, the recessed end portion is recessed away toward the upstream side in the direction of conveyance of the sheets. Thus, the distance from the recessed end portion to the nip region is longer, and the leading end of the sheet is in contact with the separation member for a longer time right after passing the recessed end portion until reaching the nip region. Accordingly, even though a plurality of sheets is stacked, the sheets are separated one by one by the separation member, and occurrence of multi-sheet feeds is reliably prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are described in detail below with reference to the drawings.

Figure 1:
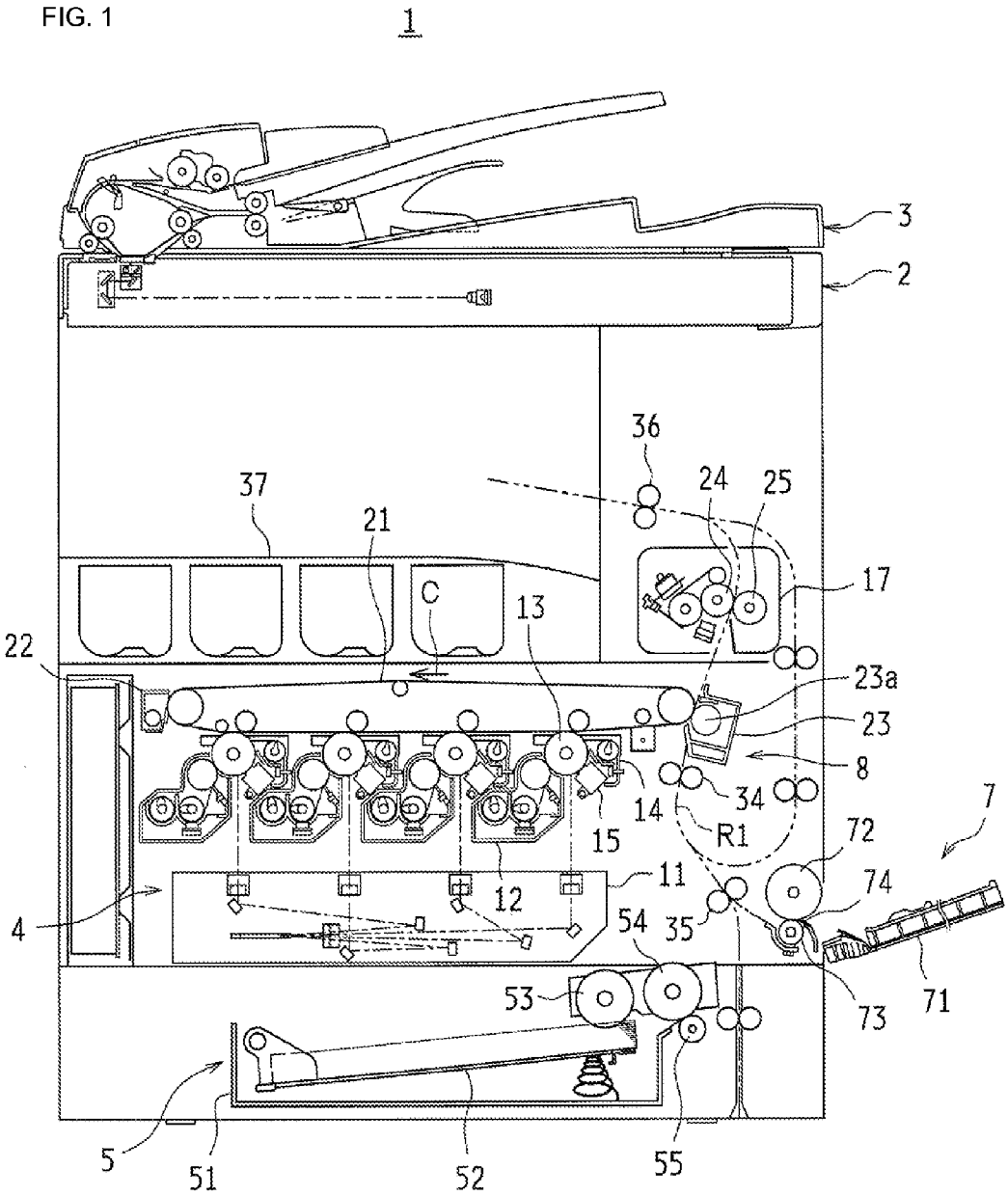
FIG. 1 is a cross-sectional view depicting an image forming apparatus applied with a manual bypass device which is a first preferred embodiment of a sheet feeding device according to the present invention.

FIG. 1 is a cross-sectional view depicting an image forming apparatus applied with a first preferred embodiment of a sheet feeding device according to the present invention. This image forming apparatus 1 has a copying function of reading a document and printing the document on a recording sheet. The image forming apparatus 1 includes, for example, a document reader 2, an automatic document feeder (ADF) 3, a printer 4, a sheet feeding device 5, a manual bypass device (a sheet feeding device according to a first preferred embodiment) 7, and a sheet conveyor 8. The document reader 2 and the automatic document feeder 3 are mounted on the upper side of the main body of the image forming apparatus 1. The printer 4, the sheet feeding device 5, and the sheet conveyor 8 are incorporated in the main body of the image forming apparatus 1. The manual bypass device 7 is attached to a sidewall of the main body of the image forming apparatus 1.

The image forming apparatus 1 handles image data corresponding to a color image using colors of black (K), cyan (C), magenta (M), and yellow (Y), or corresponding to a monochrome image using a single color, e.g., black. Thus, in the printer 4, for example, four developing devices 12, four photosensitive drums 13, four drum cleaning devices 14, and four charging devices 15, each one of which are associated with black, cyan, magenta, and yellow, respectively, are preferably provided so as to form four kinds of toner images that correspond to each color, thus configuring four image stations Pa, Pb, Pc, and Pd.

In each of the image stations Pa, Pb, Pc, and Pd, the drum cleaning device 14 removes and recovers residual toner on the surface of the photosensitive drum 13, then the charging device 15 uniformly charges the surface of the photosensitive drum 13 to a predetermined potential, an optical scanning device 11 exposes the surface of the photosensitive drum 13 so as to form an electrostatic latent image thereon, and the developing device 12 develops the electrostatic latent image on the surface of the photosensitive drum 13 to form a toner image on the surface of the photosensitive drum 13. In this manner, a toner image of each color is formed on the surface of each photosensitive drum 13.

After that, a belt cleaning device 22 removes and recovers residual toner on an intermediate transfer belt 21, and the toner image of each color formed on the surface of each photosensitive drum 13 is transferred on the intermediate transfer belt 21, so as to form a color toner image on the intermediate transfer belt 21, with the intermediate transfer belt 21 being moved in a circulating manner in the direction of arrow C.

A nip region is provided between the intermediate transfer belt 21 and a transfer roller 23*a* of a secondary transfer device 23. Color toner images on the surface of the intermediate transfer belt 21 are transferred on recording sheets with the recording sheets conveyed along an S-shaped sheet conveying path R1 being nipped in the nip region for conveyance. Then, the recording sheets are nipped between a heating roller 24 and a pressing roller 25 in a fixing device 17 so as to be subjected to heat and pressure thereon, such that color toner images are fixed on the recording sheets.

Meanwhile, in the sheet conveyor 8, recording sheets are forwarded from the sheet feeding device 5 and the manual bypass device 7 to be conveyed along the sheet conveying path R1, and the recording sheets are delivered past the secondary transfer device 23 and the fixing device 17 to a sheet discharge tray 37 by way of sheet discharge rollers 36. For example, registration rollers 34, conveyance rollers 35, and the sheet discharge rollers 36 are arranged on the sheet conveying path R1. The registration rollers 34 cause the recording sheets to stop once for registration of the recording sheets at the leading ends thereof, and then to start conveyance of the recording sheets at the timing where toner images are transferred at the nip region between the intermediate transfer belt 21 and the transfer roller 23*a*. The conveyance rollers 35 assist conveyance of the recording sheets.

The sheet feeding device 5 includes, for example, a cassette 51 that is positioned in a lower portion of the image forming apparatus 1, a sheet feed tray 52 to be loaded with recording sheets, a pickup roller 53 that is disposed on the upper side of one end of the sheet feed tray 52, a sheet feed roller 54 that is positioned downstream of the pickup roller 53 in the direction of sheet conveyance, and a separation roller 55 that is in pressing contact with the sheet feed roller 54. In the sheet feeding device 5, recording sheets are drawn by the pickup roller 53 from the sheet feed tray 52 and are guided to the sheet feed roller 54, and the recording sheets are passed in between the sheet feed roller 54 and the separation roller 55 to separate the sheets one by one, so as to forward the individual sheets onto the sheet conveying path R1.

The manual bypass device 7 is positioned on the sidewall of the main body of the image forming apparatus 1. The manual bypass device 7 includes, for example, a manual feed tray 71 to be loaded with recording sheets, a sheet feed roller 72 disposed on the upper side of one end of the manual feed tray 71, a separation roller 73 that is in pressing contact with the sheet feed roller 72, and a sheet guide member 74 that is positioned upstream of a nip region between the sheet feed roller 72 and the separation roller 73 in the direction of conveyance of the recording sheets. In the manual bypass device 7, recording sheets are guided from the manual feed tray 71 past the sheet guide member 74 to the nip region between the sheet feed roller 72 and the separation roller 73, such that the recording sheets are passed through the nip region to separate the recording sheets one by one, so as to forward the individual sheets onto the sheet conveying path R1.

Figure 2:
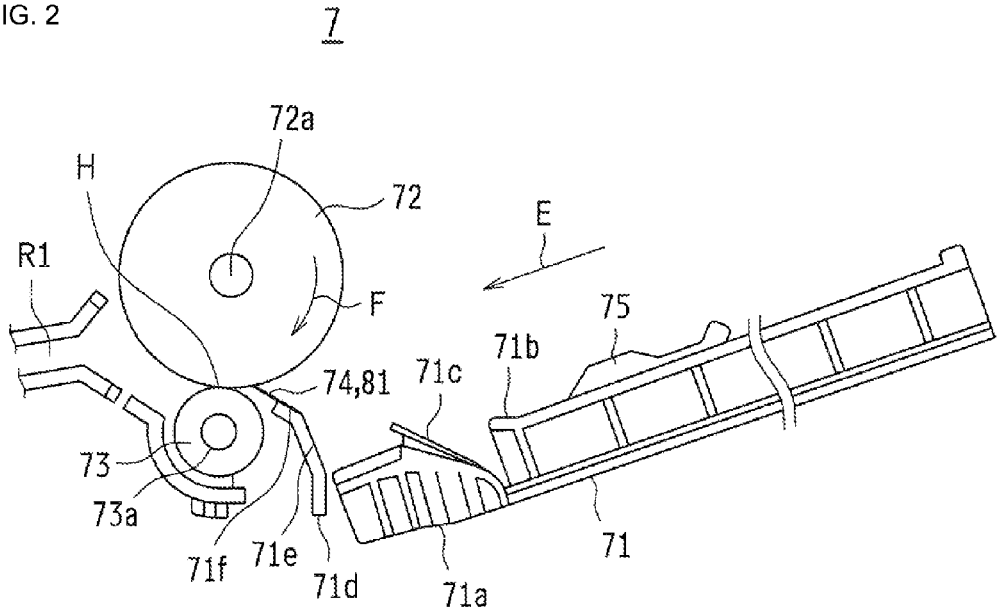
FIG. 2 is a side view schematically depicting the manual bypass device of the first preferred embodiment of the present invention.
Figure 3:
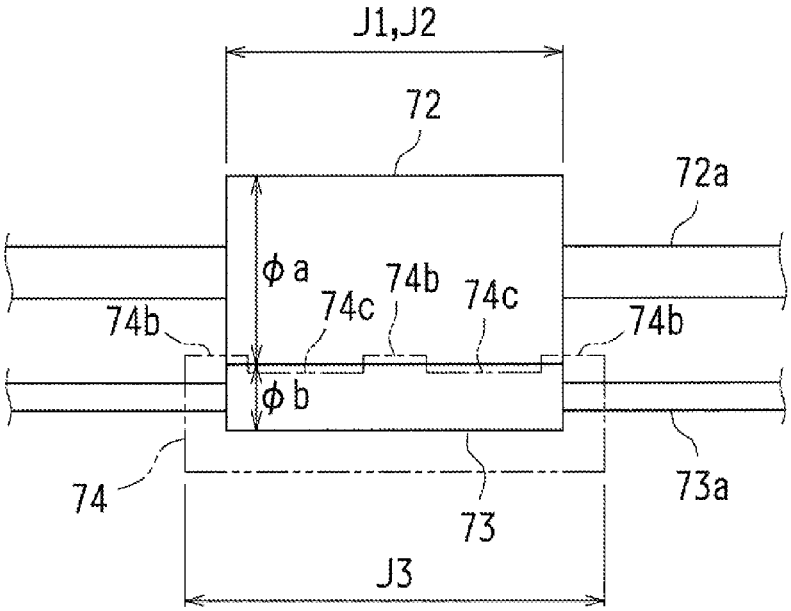
FIG. 3 is a front view of a sheet feed roller, a separation roller, and a sheet guide member of the manual bypass device of FIG. 2 as viewed from the upstream side in a direction of sheet conveyance.

Next, detailed description is given of the manual bypass device 7 in the first preferred embodiment of the sheet feeding device according to the present invention. FIG. 2 is a side view schematically depicting the manual bypass device 7. FIG. 3 is a front view of the sheet feed roller 72, the separation roller 73, and the sheet guide member 74 in the manual bypass device 7 as viewed from the upstream side in a direction E of sheet conveyance, i.e., from the manual feed tray 71 side.

As depicted in FIGS. 2 and 3, the manual feed tray 71 is disposed at an angle such that a leading end portion 71*a* is directed downward. The leading end portion 71*a* is provided with a first slant contacting portion 71*b*, a second slant contacting portion 71*c*, and a third slant contacting portion 71*d* sequentially from the upstream side in the direction E of sheet conveyance of the recording sheets. A pair of guide plates 75 configured to nip and guide recording sheets is disposed on the upper surface of the manual feed tray 71. The guide plates 75 are movably disposed in a direction perpendicular or substantially perpendicular to the direction E of sheet conveyance and are moved by a mechanism (not shown) in conjunction with each other in a symmetrical manner with respect to the center of the manual feed tray 71, such that the center of the recording sheets held between the guide plates 75 is aligned with the center of the manual feed tray 71.

The sheet feed roller 72 is positioned above the third slant contacting portion 71*d* of the leading end portion 71*a* of the manual feed tray 71. The separation roller 73 is positioned below the sheet feed roller 72. The separation roller 73 includes a shaft 73*a* that is parallel or substantially parallel with a drive shaft 72*a* of the sheet feed roller 72. A spring (not shown) urges a bearing (not shown) of the shaft 73*a* of the separation roller 73 toward the sheet feed roller 72 such that the separation roller 73 is made to pressingly contact the sheet feed roller 72, so as to provide a nip region H between the sheet feed roller 72 and the separation roller 73.

For example, the sheet feed roller 72 and the separation roller 73 are preferably made of a cylindrical rubber. The sheet feed roller 72 preferably has a diameter ϕa of approximately 30 mm, whereas the separation roller 73 preferably has a diameter ϕb of approximately 16 mm, for example. The sheet feed roller 72 preferably has a width J1 that is approximately the same, i.e., approximately 40 mm, as a width J2 of the separation roller 73 in the lengthwise direction of the drive shaft 72*a* of the sheet feed roller 72.

The third slant contacting portion 71*d* includes a contacting surface 71*e* and a slant surface 71*f* that is bent and inclined toward the nip region H at the upper end of the contacting surface 71*e*. The sheet guide member 74 is fixedly attached to the slant surface 71*f*. The sheet guide member 74 extends to the surface of the sheet feed roller 72. The sheet guide member 74 includes a leading end that is in contact with the surface of the sheet feed roller 72 or is slightly spaced apart from the surface.

Figure 4A:
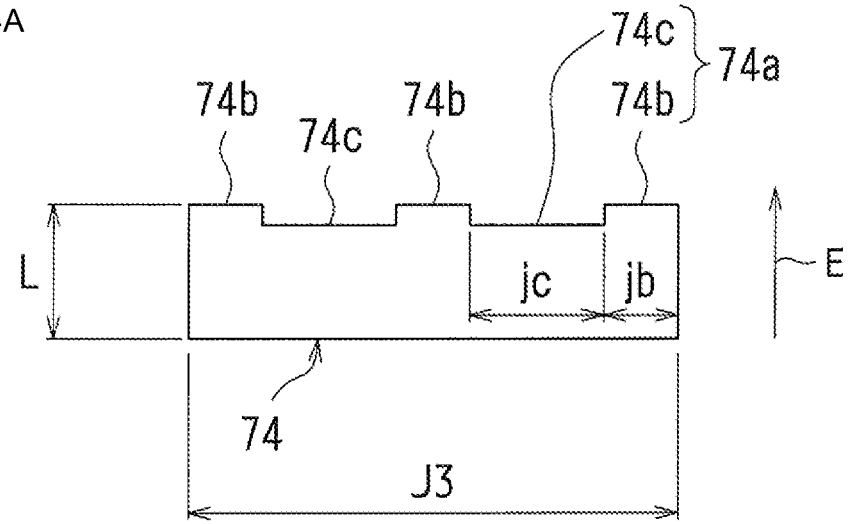
FIG. 4A is a plan view depicting the sheet guide member.

FIG. 4A is a plan view depicting the sheet guide member 74. As depicted in FIG. 4A, the sheet guide member 74 preferably has a rectangular or approximately rectangular shape, for example. A leading end portion 74*a* of the sheet guide member 74 that faces downstream side in the direction E of sheet conveyance is provided with projected end portions 74*b* and recessed end portions 74*c* alternately in the direction perpendicular or substantially perpendicular to the direction E of sheet conveyance. The projected end portions 74*b* project toward the downstream side in the direction E of sheet conveyance. The recessed end portions 74*c* are recessed from the projected end portion 74*b* toward the upstream side in the direction E of sheet conveyance.

As depicted in FIG. 3, two projected end portions 74*b* are arranged on two sides of the leading end portion 74*a* of the sheet guide member 74 in the lengthwise direction of the drive shaft 72*a* of the sheet feed roller 72. One of the projected end portions 74*b* is positioned at the center of the leading end portion 74*a* of the sheet guide member 74. The two projected end portions 74*b* arranged on the two sides of the leading end portion 74*a* of the sheet guide member 74 oppose two lateral ends of the sheet feed roller 72 lengthwise of the drive shaft 72*a*, in a direction perpendicular or substantially perpendicular to the lengthwise direction. More specifically, the two projected end portions 74*b* on both of the two sides of the leading end portion 74*a* continuously extend in the lengthwise direction of the drive shaft 72*a* from the respective inner sides of the lateral ends of the sheet feed roller 72, i.e., from within the sheet feed roller 72 region, to the respective outer sides of the lateral ends of the sheet feed roller 72, i.e., to the outside of the sheet feed roller 72 region. The two projected end portions 74*b* on both of the two sides of the leading end portion 74*a* oppose the lateral ends of the sheet feed roller 72 in the direction perpendicular or substantially perpendicular to the lengthwise direction. The projected end portion 74*b* at the center of the leading end portion 74*a* of the sheet guide member 74 opposes a central portion of the sheet feed roller 72 lengthwise of the drive shaft 72*a*, in the direction perpendicular or substantially perpendicular to the lengthwise direction.

The sheet guide member 74 is a flexible film preferably made of a synthetic resin such as polyethylene-telephthalate (PET) and preferably has a thickness of approximately 188 μm, for example. The sheet guide member 74 preferably has a width J3 of approximately 45 mm, for example, which is wider than the width J1 of the sheet feed roller 72 and the width J2 of the separation roller 73 in the lengthwise direction of the drive shaft 72*a* of the sheet feed roller 72. The projected end portions 74*b* preferably have a width jb of approximately 7 mm, for example. The recessed end portions 74*c* preferably have a width jc of approximately 12 mm, for example. Moreover, the sheet guide member 74 preferably has a length L of approximately 11 mm in the direction E of sheet conveyance, for example. The projected end portions 74*b* project from the recessed end portions 74*c* preferably by approximately 0.6 mm, for example, toward the downstream side, i.e., toward the surface of the sheet feed roller 72, in the direction E of sheet conveyance. In contrast, the recessed end portions 74*c* are recessed from the projected end portions 74*b* preferably by approximately 0.6 mm, for example, toward the upstream side, i.e., in a direction away from the surface of the sheet feed roller 72, in the direction E of sheet conveyance.

Figure 4B:
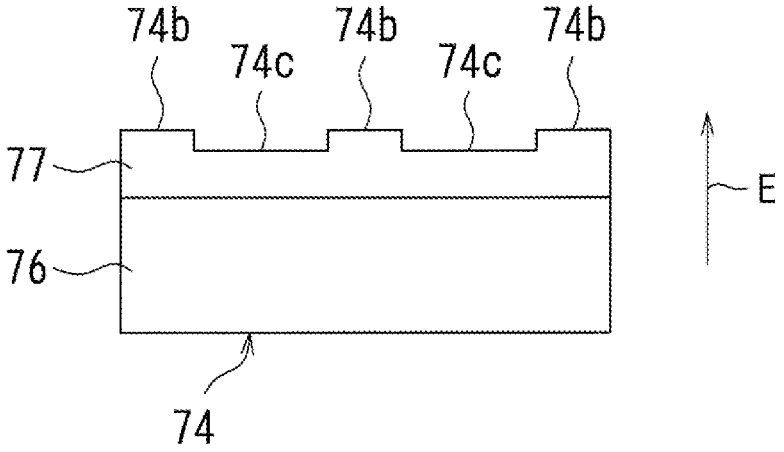
FIG. 4B is a plan view depicting a variation of the sheet guide member.

It is to be noted that the sheet guide member 74 may be made of a stainless panel on the order of about 50 μm in thickness, for example. Alternatively, as depicted in FIG. 4B, a flexible film 77 made of a synthetic resin such as PET may be placed over and applied to a stainless panel 76 such that the film 77 sticks out from the stainless panel 76 toward the downstream side in the direction E of sheet conveyance.

Figure 5:
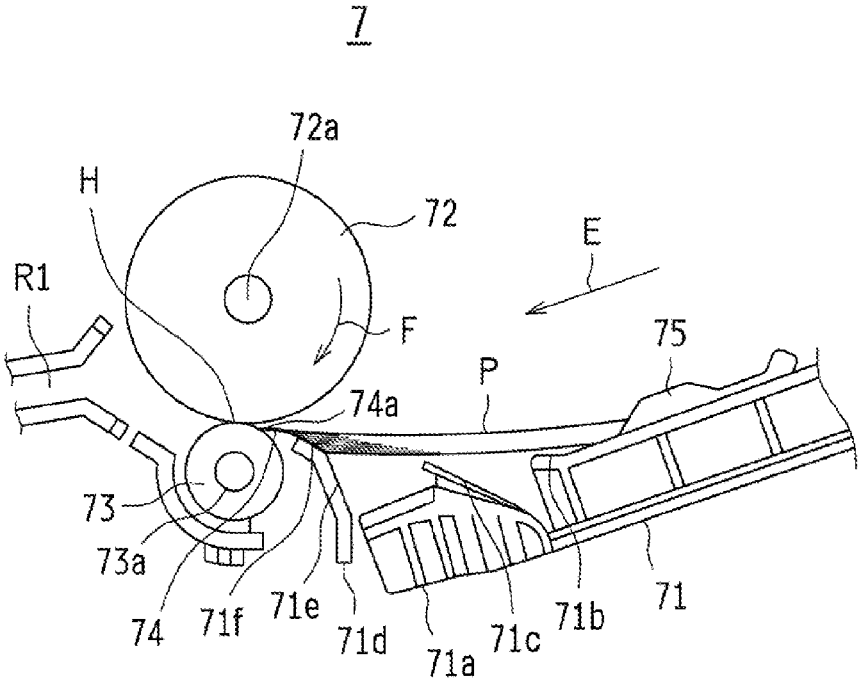
FIG. 5 is a side view schematically depicting the periphery of the sheet guide member of the manual bypass device of FIG. 2 in an enlarged manner.

In the manual bypass device 7 thus configured, as depicted in FIG. 5, a sheet bundle of recording sheets P is loaded on the manual feed tray 71, and the sheet bundle of the recording sheets P is held by the guide plates 75 on the upper surface of the manual feed tray 71, such that the center of the recording sheets P is aligned with the center of the manual feed tray 71. Further, the sheet bundle of the recording sheets P slides off downward along the inclination of the manual feed tray 71, or is slid off by the user downward along the inclination of the manual feed tray 71. An end surface of the sheet bundle passes over the first slant contacting portion 71*b* and the second slant contacting portion 71*c* of the manual feed tray 71, so as to butt the contacting surface 71*e* of the third slant contacting portion 71*d*. Moreover, the end surface of the sheet bundle butts the sheet guide member 74 to be aligned thereby, and the recording sheet P at the uppermost layer of the sheet bundle slides over the surface of the sheet guide member 74, such that the leading end of the recording sheet P at the uppermost layer is guided by the surface of the sheet feed roller 72 to be in contact therewith.

In this state, upon rotationally driving the sheet feed roller 72 in the direction of arrow F, the recording sheet P at the uppermost layer is drawn by the sheet feed roller 72 and slides over the surface of the sheet guide member 74 to be guided to the nip region H. At this time, as depicted in an enlarged manner in FIG. 5, the sheet guide member 74 flexes along the recording sheets P, and the leading end of the sheet guide member 74 touches the separation roller 73 to be directed toward the nip region H. The leading end of the recording sheet P is guided to the nip region H along the leading end portion 74*a* of the sheet guide member 74 and also in contact with the surface of the separation roller 73. The recording sheet P passes through the nip region H to be forwarded onto the sheet conveying path R1. With the drawing and conveyance of the recording sheet P at the uppermost layer, a following recording sheet P is guided to the surface of the sheet feed roller 72 to be in contact therewith, and the following recording sheet P comes to the uppermost layer. This recording sheet P passes through the nip region H according to the same procedure to be forwarded onto the sheet conveying path R1.

A torque limiter (not shown) is preferably disposed on the shaft 73*a* of the separation roller 73. When the separation roller 73 is in direct pressing contact with the sheet feed roller 72, or when the separation roller 73 is pressed against the sheet feed roller 72 with one recording sheet interposed therebetween, the turning force of the sheet feed roller 72 is transmitted to the separation roller 73 as it is, which magnifies the torque to act on the torque limiter on the separation roller 73. As a result, the separation roller 73 comes into an idling state, such that the separation roller 73 is driven into rotation by the sheet feed roller 72.

Thus, in case where the recording sheets P are sequentially drawn one by one from the manual feed tray 71, when a recording sheet P is guided to and nipped in the nip region H between the sheet feed roller 72 and the separation roller 73, the separation roller 73 comes into an idling state to be driven into rotation, such that the recording sheet P is conveyed by the sheet feed roller 72.

When a plurality of recording sheets P is drawn simultaneously from the manual feed tray 71, even though the recording sheet that directly touches the sheet feed roller 72 is conveyed by the sheet feed roller 72, the torque that acts on the torque limiter on the separation roller 73 does not increase, for the recording sheets interposed between the sheet feed roller 72 and the separation roller 73 shift from each other. Thus, the separation roller 73 comes to a halt and is not driven into rotation, such that the other recording sheets that do not directly touch the sheet feed roller 72 are stopped from being conveyed, and the other recording sheets are separated from the recording sheet that is being conveyed by the sheet feed roller 72.

It is to be noted here that as depicted in FIGS. 3 and 4A, the projected end portions 74*b* project from the recessed end portions 74*c* preferably by approximately 0.6 mm, for example, toward the downstream side in the direction E of sheet conveyance, and that in contrast, the recessed end portions 74*c* are recessed from the projected end portions 74*b* preferably by approximately 0.6 mm, for example, toward the upstream side in the direction E of sheet conveyance. Thus, in guiding the leading end of a recording sheet P to the nip region H along the leading end portion 74*a* of the sheet guide member 74 and also in contact with the surface of the separation roller 73, the leading end of the recording sheet P moves while sliding on the surfaces of the projected end portions 74*b* to be guided to the vicinity of the nip region H, and the leading end of the recording sheet P quickly passes through the nip region H. Hence, a sheet feed error is less likely to occur. Further, since the distance from the recessed end portions 74*c* to the nip region H is longer, and the leading end of the recording sheet P is in contact with the separation roller 73 for a longer time right after passing the recessed end portions 74*c* until reaching the nip region H, the recording sheets P are separated one by one by the separation roller 73 even though a plurality of recording sheets P is stacked, and a multi-sheet feed is less likely to occur.

Further, since the projected end portions 74*b* are provided on the two sides of the leading end portion 74*a* of the sheet guide member 74, the leading end of the recording sheet P is guided to the nip region H with two portions at the leading end being in contact with the projected end portion 74*bs* on the two sides, which two portions are equidistant from the center of the leading end of the recording sheet P. Thus, the recording sheets P are less likely to veer off course, and sheet feed errors are more reliably prevented.

Further, since the projected end portions 74*b* oppose the two lateral ends of the sheet feed roller 72, even though the leading end of the recording sheet P curls down, the leading end of the recording sheet is guided to the nip region H without being hooked at a lateral end or a corner of the separation roller 73, and sheet feed errors are more favorably prevented.

Further, since a projected end portion 74*b* is positioned at the center of the leading end portion 74*a* of the sheet guide member 74, even though the leading end of the recording sheet P curls up or down, a central portion of the leading end of the recording sheet P is held between the projected end portion 74*b* at the center and the sheet feed roller 72; hence, the curling degree at the central portion of the leading end of the recording sheet P is significantly reduced, and the curling at two sides of the central portion of the leading end is also reduced equally or approximately equally. Accordingly, the recording sheet P is guided to the nip region H with the two sides of the central portion of the leading end of the recording sheet P approximately straightened out, such that the recording sheets P are less likely to veer off course, and sheet feed errors are even more reliably prevented.

Figure 6:
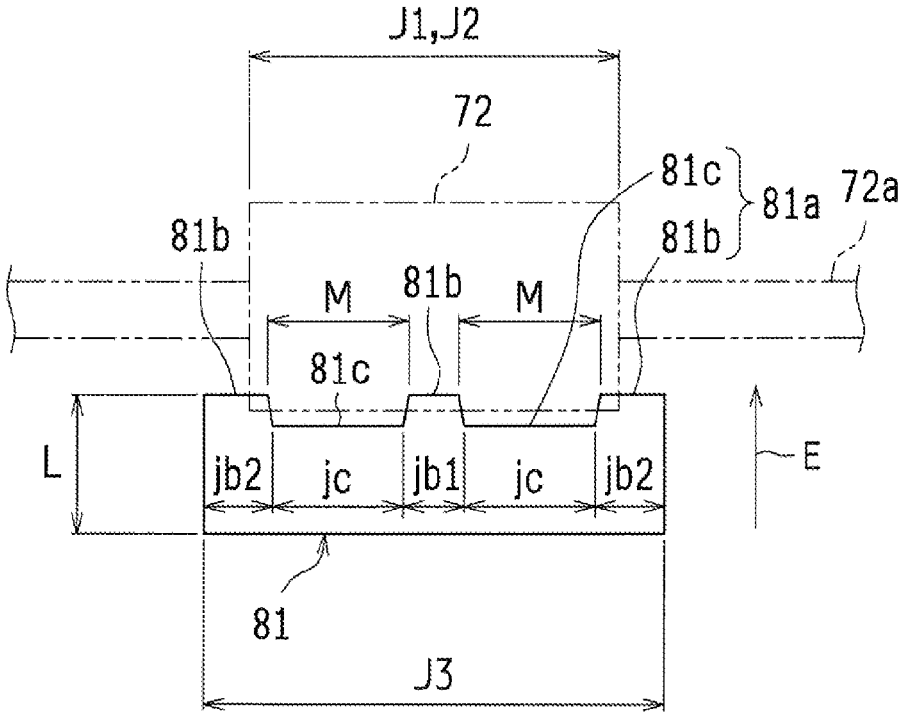
FIG. 6 is a plan view depicting a sheet guide member of a manual bypass device which is a second preferred embodiment of the sheet feeding device according to the present invention.

Next, detailed description is given of a manual bypass device 7 which is a second preferred embodiment of the sheet feeding device according to the present invention. FIG. 6 is a plan view depicting a sheet guide member 81 in the manual bypass device 7 of the second preferred embodiment.

The manual bypass device 7 of the second preferred embodiment is, like the manual bypass device 7 depicted in FIG. 1, disposed on a sidewall of the main body of the image forming apparatus 1 and is configured to forward recording sheets P onto the sheet conveying path R1. The manual bypass device 7 of the second preferred embodiment is however different from the manual bypass device 7 of the first preferred embodiment in that the sheet guide member 81 depicted in FIG. 6 is provided in place of the sheet guide member 74 depicted in FIG. 4A.

The sheet guide member 81 depicted in FIG. 6 is, like the sheet guide member 74 depicted in FIG. 4A, fixedly attached to the slant surface 71*f* of the third slant contacting portion 71*d*, extends to the surface of the sheet feed roller 72, and includes a leading end that is in contact with the surface of the sheet feed roller 72 or is slightly spaced apart from the surface.

The sheet guide member 81 preferably has a rectangular or approximately rectangular shape, for example. A leading end portion 81*a* of the sheet guide member 81 that faces downstream side in the direction E of sheet conveyance is provided with projected end portions 81*b* and recessed end portions 81*c* alternately in a direction perpendicular or substantially perpendicular to the direction E of sheet conveyance. Two projected end portions 81*b* are arranged on two sides of the leading end portion 81*a* in the lengthwise direction of the drive shaft 72*a* of the sheet feed roller 72. One of the projected end portions 81*b* is positioned at the center of the leading end portion 81*a*. The two projected end portions 81*b* arranged on the two sides of the leading end portion 81*a* oppose two lateral ends of the sheet feed roller 72 lengthwise of the drive shaft 72*a*, in the direction perpendicular or substantially perpendicular to the lengthwise direction. More specifically, the two projected end portions 81*b* on both of the two sides of the leading end portion 81*a* continuously extend in the lengthwise direction of the drive shaft 72*a* from the respective inner sides of the lateral ends of the sheet feed roller 72, i.e., from within the sheet feed roller 72 region, to the respective outer sides of the lateral ends of the sheet feed roller 72, i.e., to the outside of the sheet feed roller 72 region. The two projected end portions 81*b* on both of the two sides of the leading end portion 81*a* oppose the lateral ends of the sheet feed roller 72 in the direction perpendicular or substantially perpendicular to the lengthwise direction. The projected end portion 81*b* at the center of the leading end portion 81*a* opposes a central portion of the sheet feed roller 72 lengthwise of the drive shaft 72*a*, in the direction perpendicular or substantially perpendicular to the lengthwise direction.

The projected end portion 81*b* at the center of the leading end portion 81*a* preferably has an isosceles trapezoidal shape with the two lateral edges thereof inclined with respect to the direction E of sheet conveyance. The projected end portion 81*b* at the center of the leading end portion 81*a* preferably has a width jb1 that is gradually reduced toward the upstream side in the direction E of sheet conveyance, i.e., closer to the nip region H. Moreover, the projected end portions 81*b* on two sides of the leading end portion 81*a* each preferably have a trapezoidal shape with the inner edge thereof inclined with respect to the direction E of sheet conveyance. The projected end portions 81*b* on two sides of the leading end portion 81*a* preferably have a width jb2 that is gradually reduced toward the upstream side in the direction E of sheet conveyance, i.e., closer to the nip region H. Thus, the projected end portions 81*b* have a distance M in between that is gradually increased toward the upstream side in the direction E of sheet conveyance, i.e., closer to the nip region H.

The sheet guide member 81 preferably is a flexible film made of a synthetic resin such as PET and preferably has a thickness of approximately 188 μm, for example. The sheet guide member 81 preferably has a width J3 of approximately 45 mm, for example, which is wider than the width J1 of the sheet feed roller 72 and the width J2 of the separation roller 73. The projected end portions 81*b* preferably have maximum widths jb1 and jb2 of approximately 7 mm, for example. The recessed end portions 81*c* preferably have a width jc of approximately 12 mm, for example. Moreover, the sheet guide member 81 preferably has a length L of approximately 11 mm, for example, in the direction E of sheet conveyance. The projected end portions 81*b* project from the recessed end portions 81*c* preferably by approximately 0.6 mm, for example, toward the downstream side in the direction E of sheet conveyance, i.e., toward the surface of the sheet feed roller 72.

It is to be noted that the sheet guide member 81 may be made of a stainless panel on the order of about 50 μm in thickness, for example. Alternatively, a film made of a synthetic resin may be applied to stainless such that the film sticks out from the stainless panel toward the downstream side in the direction E of sheet conveyance.

In the manual bypass device 7 thus configured, a sheet bundle of recording sheets P is loaded on the manual feed tray 71, an end surface of the sheet bundle passes over the first slant contacting portion 71*b* and the second slant contacting portion 71*c* of the manual feed tray 71 to butt the contacting surface 71*e* of the third slant contacting portion 71*d*. The end surface of the sheet bundle butts the sheet guide member 81 to be aligned thereby, and the recording sheet P at the uppermost layer of the sheet bundle slides over the surface of the sheet guide member 81, such that the leading end of the recording sheet P at the uppermost layer is guided by the surface of the sheet feed roller 72 to be in contact therewith.

In this state, upon rotationally driving the sheet feed roller 72 in the direction of arrow F, the recording sheet P at the uppermost layer is drawn by the sheet feed roller 72 and slides over the surface of the sheet guide member 81 to be guided to the nip region H. At this time, as depicted in FIG. 5, the sheet guide member 81 flexes along the recording sheets P, and the leading end of the sheet guide member 81 touches the separation roller 73 to be directed toward the nip region H. The leading end of the recording sheet P is guided to the nip region H along the leading end portion 81*a* of the sheet guide member 81 and also in contact with the surface of the separation roller 73. The recording sheet P passes through the nip region H to be forwarded onto the sheet conveying path R1.

Then, the leading end of the recording sheet P moves while sliding on the surfaces of the projected end portions 81*b* to be guided to the vicinity of the nip region H. Thus, the leading end of the recording sheet P quickly passes through the nip region H, and sheet feed errors are significantly reduced or prevented.

Further, since the leading end of the recording sheet P is in contact with the separation roller 73 for a longer time right after passing the recessed end portions 81*c* until reaching the nip region H, even though a plurality of recording sheets P is stacked, the recording sheets P are separated one by one by the separation roller 73, and a multi-sheet feed is less likely to occur.

And besides, since the distance M between the projected end portions 81*b* is gradually increased toward the upstream side in the direction E of sheet conveyance, i.e., closer to the nip region H, the area of contact of the recording sheet P with the surface of the separation roller 73 is increased as the leading end of the recording sheet P approaches the nip region H, and thus the separation roller 73 provides an enhanced effect of preventing multi-sheet feeds of recording sheets P.

Figure 7:
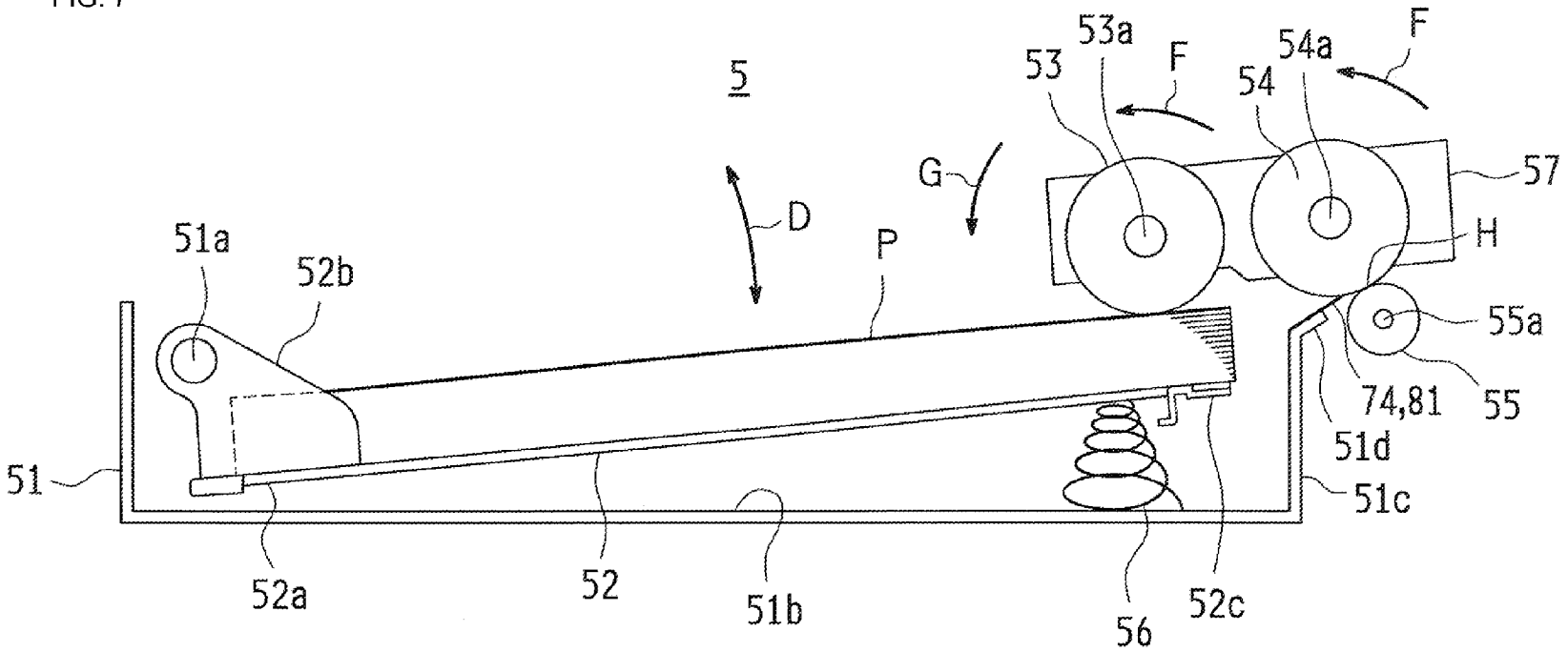
FIG. 7 is a side view schematically depicting a sheet feeding device according to a third preferred embodiment of the present invention.

Next, detailed description is given of a sheet feeding device 5 according to a third preferred embodiment of the present invention. FIG. 7 is a side view schematically depicting the sheet feeding device 5 according to the third preferred embodiment.

In the sheet feeding device 5 according to the third preferred embodiment, support pieces 52*b* are disposed in a projecting manner on two sides of a rear end portion 52*a* of the sheet feed tray 52. Shafts 51*a* that are disposed in a projecting manner on inner walls (not shown) on two sides of the cassette 51 are passed through openings in the support pieces 52*b*, thus supporting the sheet feed tray 52 such that the sheet feed tray 52 is freely rotatable with respect to the shafts 51*a* in the direction of arrow D.

A conical coil spring 56 is fixedly attached to a bottom portion 51*b* of the cassette 51. The conical coil spring 56 is held between a leading end portion 52*c* of the sheet feed tray 52 and the bottom portion 51*b* of the cassette 51, such that the leading end portion 52*c* of the sheet feed tray 52 is urged upward by the conical coil spring 56. In a case where recording sheets P are placed on the sheet feed tray 52, the leading end portion 52*c* of the sheet feed tray 52 is urged upward by the conical coil spring 56, such that the pickup roller 53 pressingly contacts the recording sheets P on the sheet feed tray 52.

A drive shaft 54*a* of the sheet feed roller 54 is passed through an opening in a first end portion of a rocking support piece 57, so as to rotatably support the rocking support piece 57. A drive shaft 53*a* of the pickup roller 53 is passed through an opening in a second end portion of the rocking support piece 57 for support. The pickup roller 53 is rotatably driven in the direction of arrow F in the same manner as the sheet feed roller 54. The separation roller 55 has a shaft 55*a* that is in parallel or substantially in parallel with the drive shaft 54*a* of the sheet feed roller 54. The separation roller 55 is in pressing contact with the sheet feed roller 54, so as to provide a nip region H between the sheet feed roller 54 and the separation roller 55. The shaft 55*a* of the separation roller 55 is preferably provided with a torque limiter (not shown) to prevent a multi-sheet feed of recording sheets P.

A sidewall 51*c* of the cassette 51 is located below the separation roller 55, and an upper end portion 51*d* of the sidewall 51*c* is bent and inclined into the direction E of sheet conveyance. The sheet guide member 74 depicted in FIG. 4A or 4B is applied and fixed to an inner slant surface of the upper end portion 51*d*. The sheet guide member 74 extends to the surface of the sheet feed roller 54. The sheet guide member 74 includes a leading end that is in contact with the surface of the sheet feed roller 54 or is slightly spaced apart from the surface.

In the sheet feeding device 5 thus configured, the rocking support piece 57 is urged in the direction of arrow G with respect to the drive shaft 54*a* of the sheet feed roller 54, and the pickup roller 53 is made to pressingly contact the recording sheet P at the uppermost layer of a sheet bundle on the sheet feed tray 52. In this state, upon rotationally driving the pickup roller 53 and the sheet feed roller 54 in the directions of arrow F, the recording sheet P at the uppermost layer of the sheet bundle on the sheet feed tray 52 is drawn by the pickup roller 53, and the sheet guide member 74 flexes along the recording sheets P. The leading end of the sheet guide member 74 touches the separation roller 55, the leading end of the recording sheet P is guided to the nip region H along the leading end portion 74*a* of the sheet guide member 74 in contact with the surface of the separation roller 55. The recording sheet P passes through the nip region H to be forwarded onto the sheet conveying path R1.

At this time, the leading end of the recording sheet P slides and moves on the surfaces of the projected end portions 74*b* to be guided to the vicinity of the nip region H. Thus, the leading end of the recording sheet P quickly passes through the nip region H, and a sheet feed error is much less likely to occur.

Further, since the leading end of the recording sheet P is in contact with the separation roller 55 for a longer time right after passing the recessed end portions 74*c* until reaching the nip region H, even though a plurality of recording sheets P is stacked, the recording sheets P are separated one by one by the separation roller 55, and thus a multi-sheet feed is much less likely to occur.

It is to be noted that the sheet guide member 81 depicted in FIG. 6 is applicable in the third preferred embodiment shown in Fi. 7 in place of the sheet guide member 74. In this case, the area of contact of the recording sheet P with the surface of the separation roller 55 is increased toward the upstream side in the direction E of sheet conveyance, i.e., closer to the nip region H; thus, the separation roller 55 provides an enhanced effect of preventing multi-sheet feeds of recording sheets P.

It is to be noted that preferred embodiments of the present invention are not limited to the foregoing first to third preferred embodiments and may be modified in various ways. For example, in place of the separation roller 73 (or 55), a separation pad may be made to pressingly contact the sheet feed roller 72 (or 54), so as to provide a nip region between the sheet feed roller 72 (or 54) and the separation pad. Recording sheets may be passed through the nip region, thus preventing multi-sheet feeds of recording sheets. In this case, the sheet guide member is disposed such that the leading end portion of the sheet guide member overlaps an end of the surface of the separation pad that faces upstream in the direction E of sheet conveyance. In this manner, the leading end of the recording sheet is guided along the sheet guide member to the nip region in sliding contact with the surface of the separation pad.

While preferred embodiments of the present invention and variations thereof have been described above, it is to be understood that variations and modifications will be apparent to those skilled in the art without departing from the scope and spirit of the present invention. The scope of the present invention, therefore, is to be determined solely by the following claims.

What is claimed is:

1. A sheet feeding device comprising:

a sheet feed tray configured to be loaded with sheets;

a sheet guide member;

a sheet feed roller configured to convey the sheets; and a separation member configured to separate the sheets to prevent a multi-sheet feed of the sheets, the sheets being guided from the sheet feed tray along the sheet guide member to a nip region between the sheet feed roller and the separation member such that the sheets are forwarded through the nip region onto a sheet conveying path; wherein projected end portions and recessed end portions are alternately arranged on a leading end portion of the sheet guide member in a direction perpendicular or substantially perpendicular to a direction of conveyance of the sheets;

the sheet guide member is directed toward a downstream side in the direction of conveyance;

the projected end portions project toward the downstream side in the direction of conveyance;

the recessed end portions are recessed from the projected end portions toward an upstream side in the direction of conveyance;

the projected end portions are provided at a position opposite to a first end of the separation member, at a position opposite to a second end of the separation member, and at a position opposite to a central portion of the sheet feed roller, and the first end, the central portion, and the second end are spaced apart in the direction perpendicular or substantially perpendicular to the direction of conveyance; and the projected end portions arranged in the positions opposite to the first end and the second end of the separation member overlap the first end and the second end of the separation member in the direction perpendicular or substantially perpendicular to the direction of conveyance of sheets when viewed in the direction of conveyance.

2. The sheet feeding device according to claim 1, wherein the projected end portions provided at the positions opposite to the first end and the second end of the separation member are arranged on two sides of the leading end portion of the sheet guide member in the direction perpendicular or substantially perpendicular to the direction of conveyance.

3. The sheet feeding device according to claim 1, wherein the projected end portions have a smaller width in the direction perpendicular or substantially perpendicular to the direction of conveyance toward the nip region.

4. An image forming apparatus comprising:

the sheet feeding device of claim 1; and a printer configured to form an image on a sheet forwarded by the sheet feeding device.

5. The image forming apparatus according to claim 4, wherein the projected end portions provided at the positions opposite to the first end and the second end of the separation member are arranged on two sides of the leading end portion of the sheet guide member in the direction perpendicular or substantially perpendicular to the direction of conveyance.

6. The image forming apparatus according to claim 4, wherein the projected end portions have a smaller width in the direction perpendicular or substantially perpendicular to the direction of conveyance toward the nip region.

7. The sheet feeding device according to claim 1, wherein one of the projected end portions continuously extends, in a lengthwise direction of the sheet feed roller, from an inner side of a first end of the sheet feed roller to an outer side of the first end of the sheet feed roller, and another one of the projected end portions continuously extends, in the lengthwise direction of the sheet feed roller, from an inner side of a second end of the sheet feed roller to an outer side of the second end of the sheet feed roller.

8. A sheet feeding device comprising:

a sheet feed tray configured to be loaded with sheets;

a sheet guide member;

a sheet feed roller configured to convey the sheets; and a separation member configured to separate the sheets to prevent a multi-sheet feed of the sheets, the sheets being guided from the sheet feed tray along the sheet guide member to a nip region between the sheet feed roller and the separation member such that the sheets are forwarded through the nip region onto a sheet conveying path; wherein projected end portions and recessed end portions are alternately arranged on a leading end portion of the sheet guide member in a direction perpendicular or substantially perpendicular to a direction of conveyance of the sheets;

the sheet guide member is directed toward a downstream side in the direction of conveyance;

the projected end portions project toward the downstream side in the direction of conveyance;

the recessed end portions are recessed from the projected end portions toward an upstream side in the direction of conveyance;

the projected end portions are provided at a position opposite to a first end of the separation member, at a position opposite to a second end of the separation member, and at a position opposite to a central portion of the sheet feed roller, and the first end, the central portion, and the second end are spaced apart in the direction perpendicular or substantially perpendicular to the direction of conveyance;

the projected end portions arranged in the positions opposite to the first end and the second end of the separation member overlap the first end and the second end of the separation member in the direction perpendicular or substantially perpendicular to the direction of conveyance of sheets; and the sheet guide member is a flexible film.

* * * * *